US008126347B2

(12) United States Patent
Kladias et al.

(10) Patent No.: US 8,126,347 B2
(45) Date of Patent: Feb. 28, 2012

(54) APPARATUS AND METHOD FOR FUSER AND PRESSURE ASSEMBLY TEMPERATURE CONTROL

(75) Inventors: Nicholas P. Kladias, Fresh Meadows, NY (US); Gerald A. Domoto, Briarcliff Manor, NY (US); Augusto E. Barton, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 713 days.

(21) Appl. No.: 12/257,504

(22) Filed: Oct. 24, 2008

(65) Prior Publication Data

US 2010/0104308 A1 Apr. 29, 2010

(51) Int. Cl.
*G03G 15/20* (2006.01)

(52) U.S. Cl. ..... 399/69

(58) Field of Classification Search ..... 399/69, 399/320, 335, 337

See application file for complete search history.

(56) References Cited

U.S. PATENT DOCUMENTS 5,568,240 A * 10/1996 Ohtsuka ..... 399/335
5,701,554 A * 12/1997 Tanaka et al. ..... 399/69
6,078,780 A * 6/2000 Abe et al. ..... 399/328
RE38,810 E * 10/2005 Terada et al. ..... 399/328
2005/0031363 A1* 2/2005 Nishi ..... 399/69
2005/0163524 A1* 7/2005 Shiobara et al. ..... 399/69
2006/0289417 A1* 12/2006 Kagawa et al. ..... 219/216

* cited by examiner

*Primary Examiner* — David Gray
*Assistant Examiner* — Rodney Bonnette
(74) *Attorney, Agent, or Firm* — Ronald E. Prass, Jr.; Prass LLP

(57) ABSTRACT

An apparatus (100) and method (700) that can control fuser temperature is disclosed. The apparatus can include an image fuser member (110) rotatably supported in the apparatus, where the image fuser member can be configured to fuse an image on media (170). The apparatus can include a heater (120) coupled to the image fuser member, where the heater can be configured to heat the image fuser member. The apparatus can include a pressure assembly (130) rotatably supported in the apparatus and coupled to the image fuser member, where the pressure assembly can be configured to exert pressure against the image fuser member. The apparatus can include a temperature sensor (140) coupled to the pressure assembly, where the temperature sensor can be configured to sense a temperature of the pressure assembly. The apparatus can include a controller (150) coupled to the heater and coupled to the temperature sensor, where the controller can be configured to adjust the temperature set point of the image fuser member based on the sensed temperature of the pressure assembly.

19 Claims, 9 Drawing Sheets

APPARATUS AND METHOD FOR FUSER AND PRESSURE ASSEMBLY TEMPERATURE CONTROL

BACKGROUND

Disclosed herein is an apparatus and method for fuser and pressure assembly temperature control.

Presently, in an image production system, a fuser can be used with a pressure assembly to fuse an image on media. For example, a marking module can mark an image on media with toner, such as ink. A fuser and pressure assembly can then fuse the toner image onto the media by applying heat and pressure to the media at a nip between the fuser and the pressure assembly. A consistent toner-media interface temperature is essential for providing consistent quality prints.

A pressure assembly, such as a pressure roll in a belt fuser architecture, can be covered with a thick overcoat of silicone rubber to provide conformability. Unfortunately, the pressure roll surface temperature varies significantly depending on the media type fed to the pressure roll. Thin media results in higher pressure roll temperatures and thicker cover media results in lower pressure roll temperatures. Too high of a pressure roll temperature can adversely affect duplex quality whereas too low of a pressure roll temperature can adversely affect the image prints. The problem of a unacceptably low pressure roll temperature often occurs when a thin media job immediately follows a long run of thick media or when the pressure roll starts from cold. Furthermore, as many copies are run in a printer, the pressure roll is heated by the fuser in the interdocument zone between copies, which causes its temperature to rise, which adversely affects duplex jobs, results in melting of toner, and destabilizes the toner-paper interface temperature.

If the pressure roll temperature is higher than the set point, an air blower or an air knife is used to cool down the pressure roll by forced convection. Significant air flow is often needed to provide adequate cooling of the pressure roll surface. If the pressure roll temperature is lower than the set point, heat is provided through an internal lamp. Unfortunately, the internal lamp does not consistently and sufficiently control the pressure roll temperature and it is not very efficient because the internal heating has to penetrate through the thick rubber overcoat. Furthermore, the internal heating results in high core temperatures and potential rubber delamination.

Thus, there is a need for apparatus and method that can control fuser and pressure assembly temperature.

SUMMARY

An apparatus and method that can control fuser and pressure assembly temperature is disclosed. The apparatus can include an image fuser member rotatably supported in the apparatus, where the image fuser member can be configured to fuse an image on media. The apparatus can include a heater coupled to the image fuser member, where the heater can be configured to heat the image fuser member. The apparatus can include a pressure assembly rotatably supported in the apparatus and coupled to the image fuser member, where the pressure assembly can be configured to exert pressure against the image fuser member. The apparatus can include a temperature sensor coupled to the pressure assembly, where the temperature sensor can be configured to sense a temperature of the pressure assembly. The apparatus can include a controller coupled to the heater and coupled to the temperature sensor, where the controller can be configured to adjust the set point temperature of the image fuser member based on the sensed temperature of the pressure assembly.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include an apparatus that can include an image fuser member rotatably supported in the apparatus, where the image fuser member can be configured to fuse an image on media. The apparatus can include a heater coupled to the image fuser member, where the heater can be configured to heat the image fuser member. The apparatus can include a pressure assembly rotatably supported in the apparatus and coupled to the image fuser member, where the pressure assembly can be configured to exert pressure against the image fuser member. The apparatus can include a temperature sensor coupled to the pressure assembly, where the temperature sensor can be configured to sense a temperature of the pressure assembly. The apparatus can include a controller coupled to the heater and coupled to the temperature sensor, where the controller can be configured to adjust the set point temperature of the image fuser member based on the sensed temperature of the pressure assembly.

The embodiments further include an apparatus that can include a media transport configured to transport media. The apparatus can include a marking module configured to mark a toner image on the media. The apparatus can include an image fuser member rotatably supported in the apparatus, where the image fuser member can be configured to fuse the toner image on the media. The apparatus can include a heater coupled to the image fuser member, where the heater can be configured to heat the image fuser member. The apparatus can include a pressure assembly rotatably supported in the apparatus and coupled to the image fuser member at a nip, where the pressure assembly can be configured to exert pressure against the media in the nip. The apparatus can include a temperature sensor coupled to the pressure assembly, where the temperature sensor can be configured to sense the temperature of the pressure assembly. The apparatus can include a controller coupled to the heater and coupled to the temperature sensor, where the controller can be configured to adjust the set point temperature of the image fuser member based on the temperature of the pressure assembly to achieve a desired toner-media interface temperature.

The embodiments further include a method that can include heating an image fuser member and sensing a temperature of the pressure assembly coupled to the image fuser member. The method can include adjusting the set point temperature of the image fuser member based on the sensed temperature of the pressure assembly.

Figure 1:
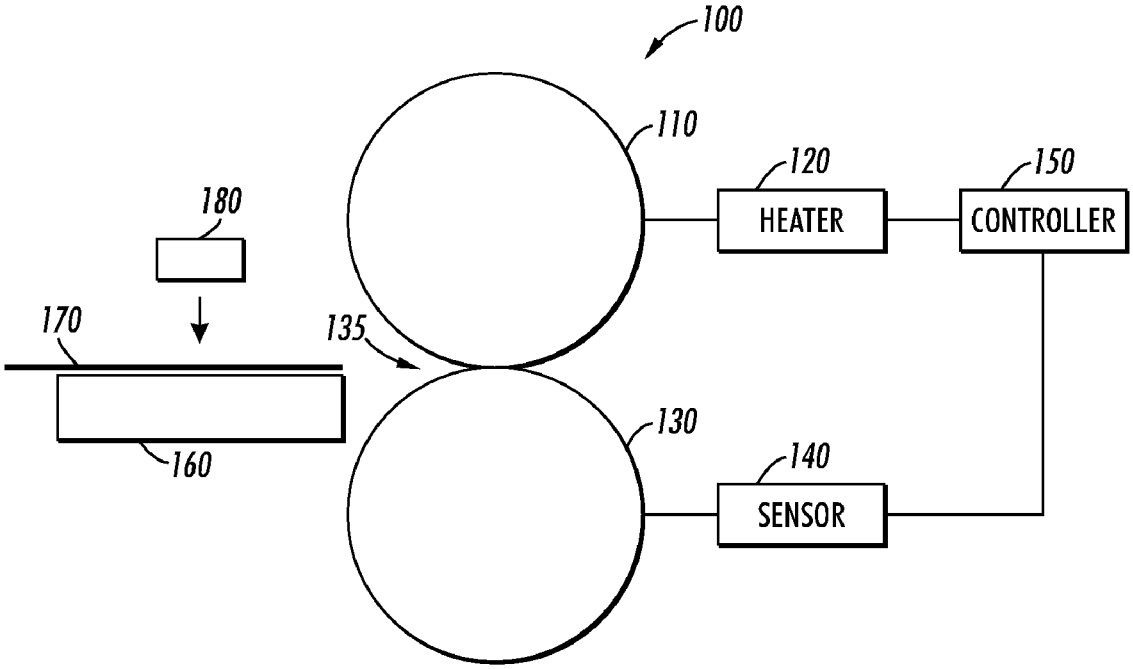
FIG. 1 is an exemplary illustration of an apparatus.

FIG. 1 is an exemplary illustration of an apparatus 100. The apparatus 100 can be a printer, a multifunction media device, a xerographic machine, or any other device that generates an image on media. The apparatus 100 can include an image fuser member 110 rotatably supported in the apparatus 100. The image fuser member 110 can be configured to fuse an image on media 170. The media 170 can be paper, plastic, transparency, or any other media that can have an image fused on it. The image fuser member 110 can be a fuser roll, a fuser belt, an ink jet print drum, an ink jet web printer spreader roll, or any other assembly that can fuse an image on media. The apparatus 100 can include a heater 120 coupled to the image fuser member 110. The heater 120 can be configured to heat the image fuser member 110. The apparatus 100 can include a pressure assembly 130 rotatably supported in the apparatus 100 and coupled to the image fuser member 110. The pressure assembly 130 can be configured to exert pressure against the image fuser member 110. The pressure assembly 130 can be a roll, a belt, or any other assembly that can exert pressure against a fuser. For example, the pressure assembly 130 can be a pressure roll including a deformable surface. The deformable surface can be a deformable overcoat, a silicone rubber overcoat, a rubber overcoat, or any other deformable surface that provides conformable pressure against a rotatable image fuser member. The apparatus 100 can include a temperature sensor 140 coupled to the pressure assembly 130. The temperature sensor 140 can be configured to sense a temperature of the pressure assembly 130. The apparatus 100 can include a controller 150 coupled to the heater 120 and coupled to the temperature sensor 140. The controller 150 can be configured to adjust the set point temperature of the image fuser member 110 based on the sensed temperature of the pressure assembly 130. For example, the controller 150 can be configured to adjust the temperature set point of the image fuser member 110. The controller 150 can make sure an image fuser roll or belt achieves the desired set point, which can be determined from the pressure assembly temperature. The functions of the controller 150 can be in one element or can be distributed throughout separate elements in the apparatus 100.

The temperature of the image fuser member 110 can control the temperature of the pressure assembly 130. The controller 150 can be configured to adjust the temperature set point of the image fuser member 110 based on the temperature of the pressure assembly 130 to achieve a desired toner-media interface temperature. For example, the controller 150 can be configured to adjust the temperature set point of the image fuser member 110 based on the temperature of the pressure assembly 130 according to the temperature of the pressure assembly 130 measured by the temperature sensor 140 and based on a desired toner-media interface temperature. The desired toner-media interface temperature can be based on a media weight of media 170 having the image fused by the fuser assembly 110. The controller 150 can be configured to adjust the temperature set point of the image fuser member 110 based on the temperature of the pressure assembly 130 until the pressure assembly 130 reaches a desired steady state temperature.

The controller 150 can be configured to adjust the set point temperature of the image fuser member 110 based on the temperature of the pressure assembly 130 measured by the temperature sensor 140, based on a desired steady state image fuser member temperature for a desired toner-media interface temperature, and based on the corresponding steady state pressure assembly temperature for the desired toner-media interface temperature, as shown in graphs 200 and 300. For example, the controller 150 can be configured to adjust the temperature set point of the image fuser member 110 based on the temperature of the pressure assembly 130 according to:

$$T_b = T_{b_ss} + a(T_{pr_ss} - T_{pr}) - b(T_{pr_ss} - T_{pr})^2$$

$T_b$ represents the adjusted image fuser member temperature set point. $T_{b_ss}$ represents the image fuser member steady state temperature set point for a target toner-media interface temperature. $T_{pr_ss}$ represents the pressure assembly steady state temperature for the image fuser member temperature set point that corresponds to the desired target toner-media interface temperature. $T_{pr}$ represents a measured pressure assembly temperature. The values a and b are coefficients that are determined so as to substantially minimize the difference between a toner-media interface temperature resulting from the adjusted image fuser member temperature and a desired toner-media interface temperature over a print job. For example, a and b can be determined to substantially minimize an error integral based on $$\int (T_{t\text{-}p} - T_{t\text{-}p,\,target})^2 dt$$

$T_{t\text{-}p}$ represents the toner-media interface temperature resulting from the adjusted image fuser member temperature and $T_{t\text{-}p,\ target}$ represents the desired toner-media interface temperature. For example, $T_{t\text{-}p}$ can represent a toner-media interface temperature resulting from the adjusted image fuser member temperature obtained from a look-up table. $T_{t\text{-}p}$ can also represent a toner-media interface temperature resulting from the adjusted image fuser member temperature according to a model. For example, $T_{t\text{-}p}$ can represent an actual toner-media interface temperature resulting from the image fuser member adjustment equation above based on a model, based on a lookup table, based on a lookup table based on a model, based on measured values, based on calculated values, or based on any other actual toner-media interface temperature.

According to a related embodiment, the apparatus 100 can include a media transport 160 configured to transport media 170. The apparatus 100 can include a marking module 180 configured to mark a toner image on the media 170. The apparatus 100 can include an image fuser member 110 rotatably supported in the apparatus 100. The image fuser member 110 can be configured to fuse the toner image on the media 170. The apparatus 100 can include a heater 120 coupled to the image fuser member 110. The heater 120 can be configured to heat the image fuser member 110. The apparatus 100 can include a pressure assembly 130 rotatably supported in the apparatus 100 and coupled to the image fuser member 110 at a nip 135. The pressure assembly 130 can be configured to exert pressure against the media 170 in the nip 135. The apparatus 100 can include a temperature sensor 140 coupled to the pressure assembly 130. The temperature sensor 140 can be configured to sense a temperature of the pressure assembly 130. The apparatus 100 can include a controller 150 coupled to the heater 120 and coupled to the temperature sensor 140. The controller 150 can be configured to adjust a temperature of the image fuser member 110 based on the temperature of the pressure assembly 130 to achieve a desired toner-media interface temperature. For example, the controller 150 can be configured to adjust the temperature set point of the image fuser member 110 based on the temperature of the pressure assembly 130 measured by the temperature sensor 140, based on a desired steady state image fuser member temperature for the desired toner-media interface temperature, and based on a desired steady state pressure assembly temperature for the desired toner-media interface temperature.

Embodiments can adjust a fuser, roll, and/or belt set point temperature depending on the temperature of a pressure roll or belt to achieve a target toner-media interface temperature throughout a print job. A transfer function can correlate the fuser set point temperature to the pressure assembly temperature. Direct heating or cooling of a pressure assembly is not required because the pressure assembly is heated by the fuser. Embodiments can achieve a stable toner-media interface temperature throughout a print job, which can lead to high image quality. In addition, embodiments can eliminate the need of warming up the pressure assembly, which can significantly reduce the warm-up time of the printing apparatus.

Figure 2:
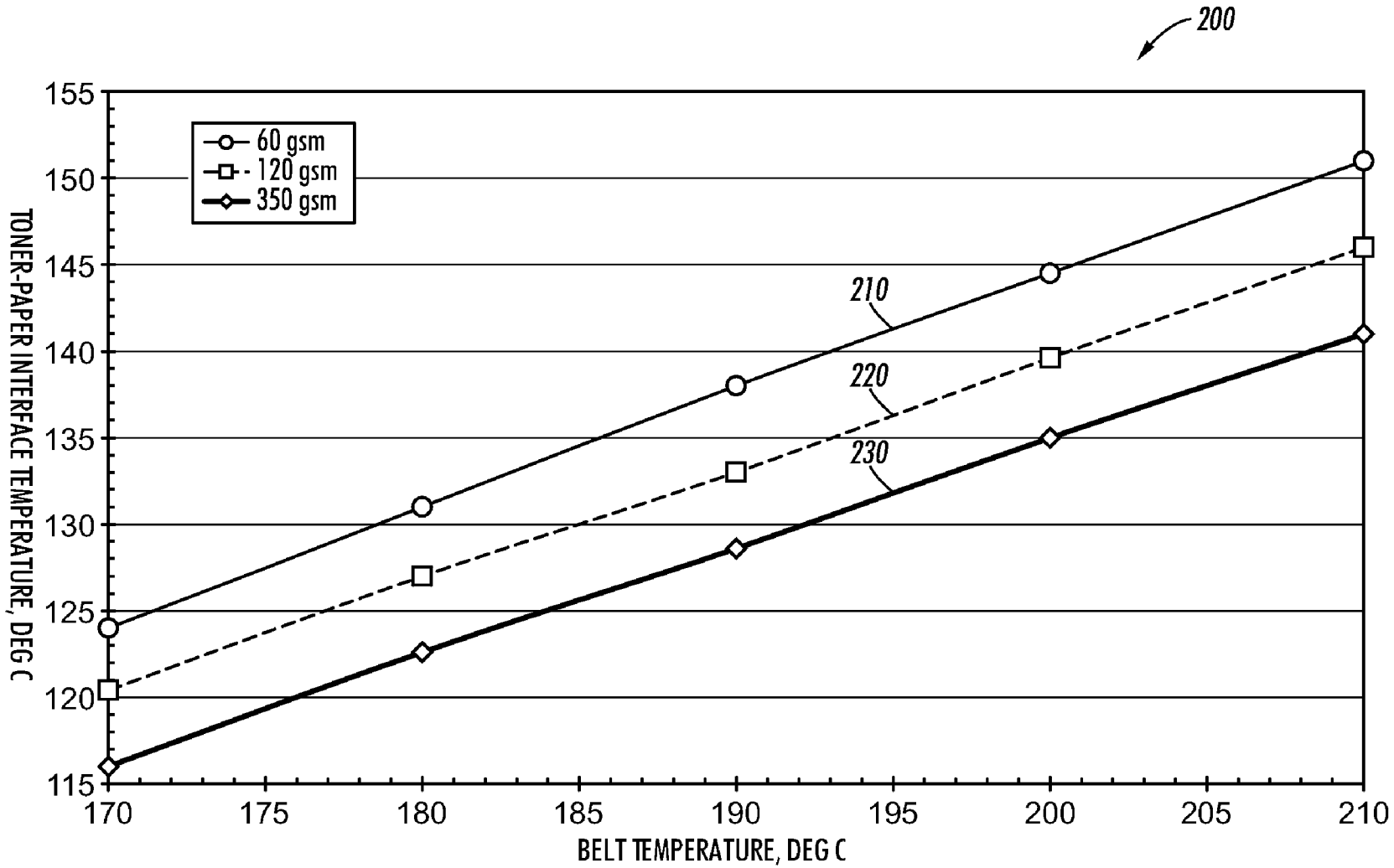
FIG. 2 illustrates an exemplary graph of steady state toner-media interface temperature as a function of fuser temperature.

FIG. 2 illustrates an exemplary graph 200 of a simulated steady state toner-media interface temperature as a function of belt temperature, such as an image fuser belt temperature, for an apparatus similar to the apparatus 100 employing an image fuser belt. The graph 200 illustrates toner-media interface temperatures for 60 grams per square meter (gsm) media weight 210, 120 gsm media weight 220, and 350 gsm media weight 230. The simulated temperatures were verified against experimental data.

Figure 3:
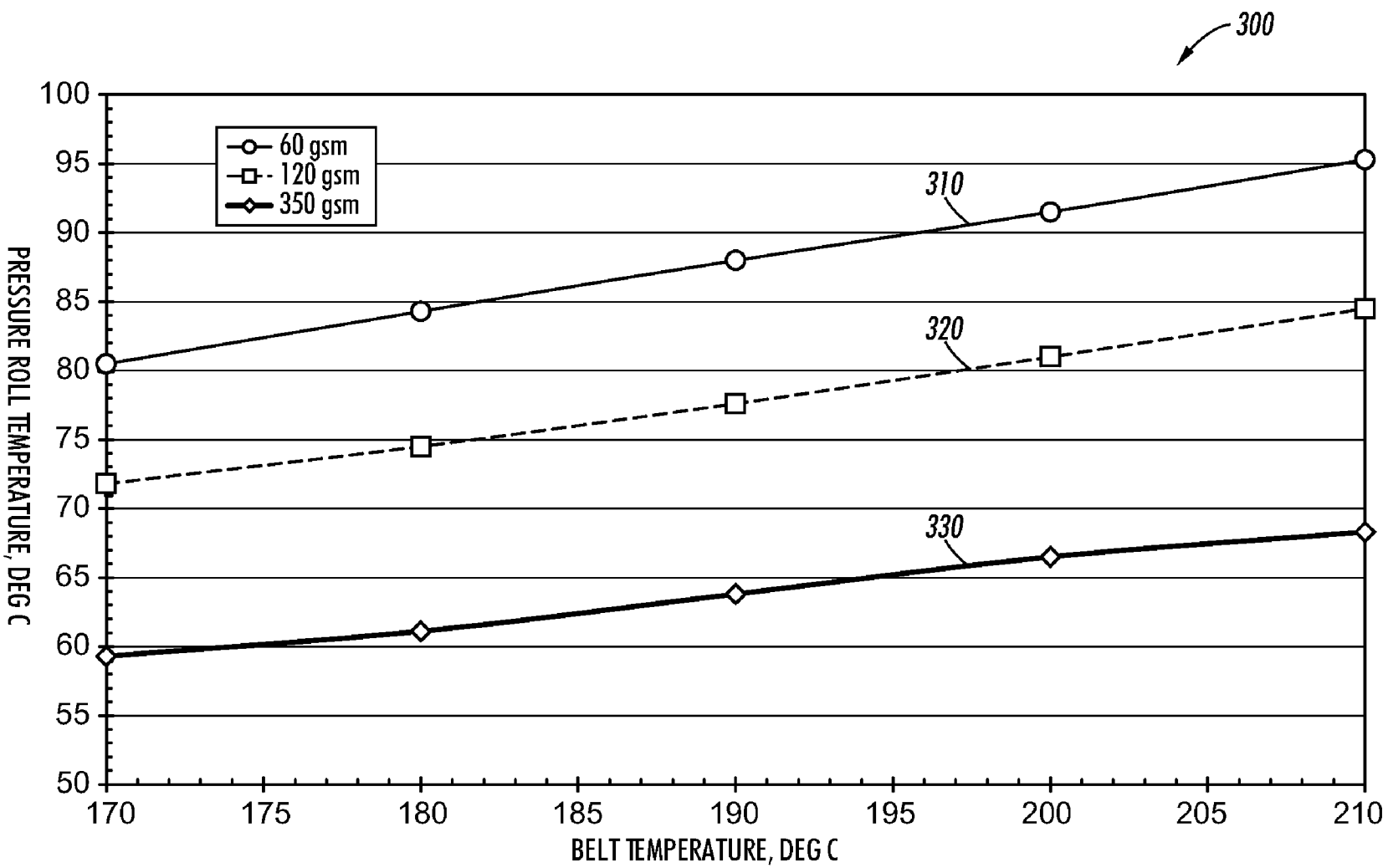
FIG. 3 illustrates an exemplary graph steady state pressure assembly temperature as a function of fuser temperature.

FIG. 3 illustrates an exemplary graph 300 of a simulated steady state pressure assembly temperature, such as pressure roll temperature, as a function of belt temperature, such as image fuser belt temperature, for an apparatus similar to the apparatus 100. The graph illustrates pressure assembly temperatures for 60 gsm media weight 310, 120 gsm media weight 320, and 350 gsm media weight 330. The simulated temperatures were verified against experimental data. Graphs 200 and 300 illustrate how a toner-media interface temperature of 125° C. can be achieved with the belt temperature set at 170° C. for 60 gsm paper at steady state. In such a case, the pressure assembly steady state temperature is 80° C. Therefore, if the target toner-paper interface temperature is 125° C., the belt temperature should be 170° C. and the corresponding pressure assembly temperature is 80° C.

Figure 4:
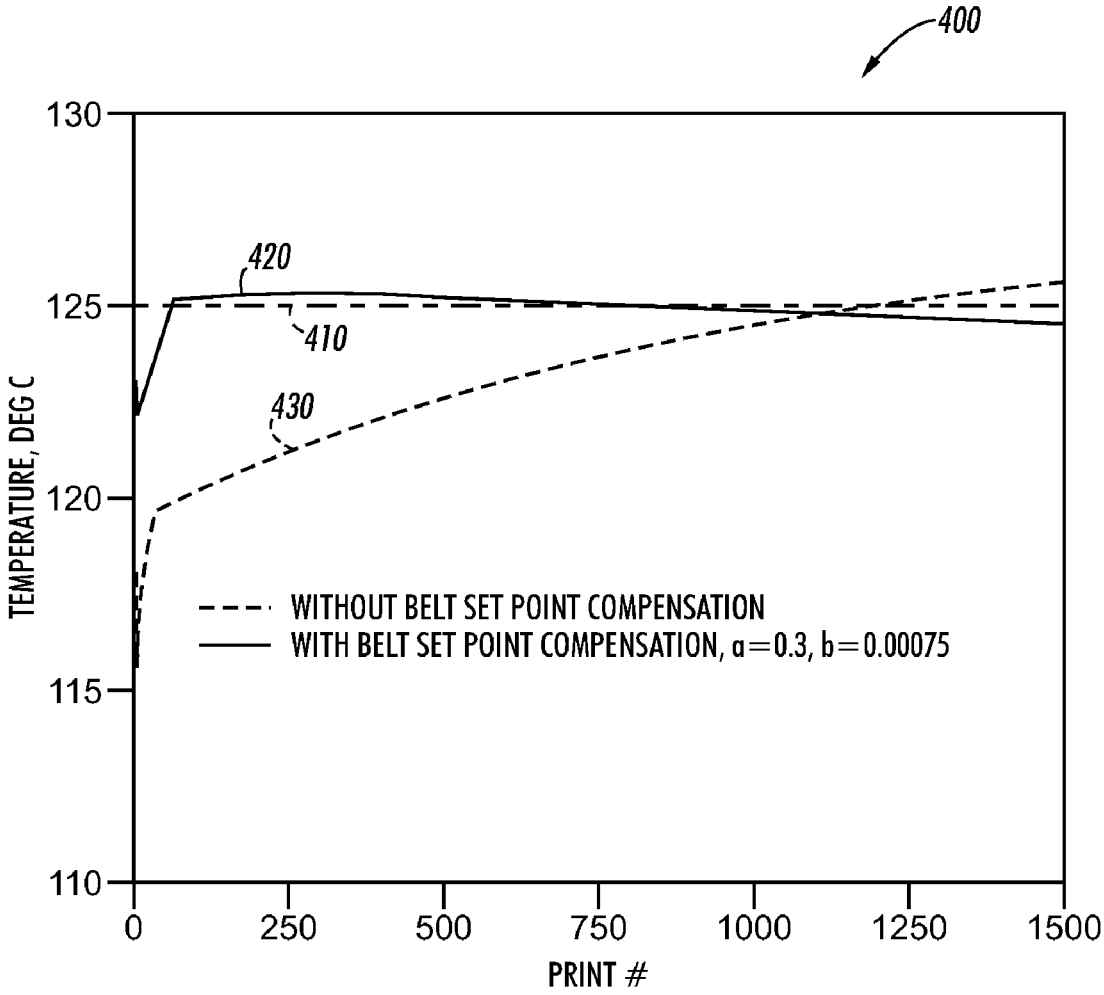
FIG. 4 illustrates an exemplary graph of toner-media interface temperature as a function of print count.

FIG. 4 illustrates an exemplary graph 400 of toner-media interface temperature as a function of a number of prints. The plot 430 shows how, if the fuser and pressure assembly start cold without set point compensation of the fuser for the pressure assembly, a desired target toner-media interface temperature 410 can be achieved only after the first 1200 prints where the first prints may achieve a toner-media interface temperature as much as 10° C. lower than the target temperature 410. The plot 420 shows that using compensation from the disclosed embodiments the desired toner-media interface temperature 410 can be achieved much faster, after the first 50 prints compared to 1200 prints, and much more uniformly throughout the print job.

According to some embodiments, the set point temperature of a fuser can be adjusted to compensate for the low temperature of an unheated pressure assembly according to:

$$T_b = T_{b_ss} + a(T_{pr_ss} - T_{pr}) - b(T_{pr_ss} - T_{pr})^2$$

where $T_b$ can represent the adjusted image fuser member temperature, where $T_{b_ss}$ can represent an image fuser member steady state temperature for a target toner-media interface temperature, where $T_{pr_ss}$ can represent a pressure assembly steady state temperature for a target toner-media interface temperature, and where $T_{pr}$ can represent a measured pressure assembly temperature. The values for the equation can be taken from simulated, modeled, or measured values, such as from the graphs 200 and 300. The coefficients a and b can be determined so as to substantially minimize the difference between the toner-media interface temperature resulting from the adjusted image fuser member temperature and the desired toner-media interface temperature. For example, a and b can be determined to substantially minimize an error integral based on:

$$\int (T_{t\text{-}p} - T_{t\text{-}p,\,target})^2 dt$$

where $T_{t\text{-}p}$ represents a toner-media interface temperature resulting from the adjusted image fuser member temperature and $T_{t\text{-}p,\,target}$ represents a desired toner-media interface temperature. The toner-media interface temperature $T_{t\text{-}p}$ can be an actual toner-media interface temperature, can be based on a model, can be measured, can be an expected toner-media interface temperature during a print job, or can be any other indication of an actual toner-media interface temperature. For example, when integrating, the desired toner-media interface temperature will be a constant. The integral can be taken over time of the toner-media interface temperature based on a model, such as shown in the graphs 200 and 300. The coefficients a and b can be changed in the formula the model can be run for different values of a and b to obtain different toner paper interface temperatures over time. The different toner paper interface temperatures over time for different values of a and b can be used as the first component, $T_{t\text{-}p}$, in the integral. Values of a and b that minimize the integral, such as values that minimize the difference between the actual and the desired toner-media interface temperature, can be used in the equation. The actual toner-media interface temperature can be the toner-media interface temperature resulting from the adjusted image fuser member temperature resulting from the compensation equation.

Figure 5:
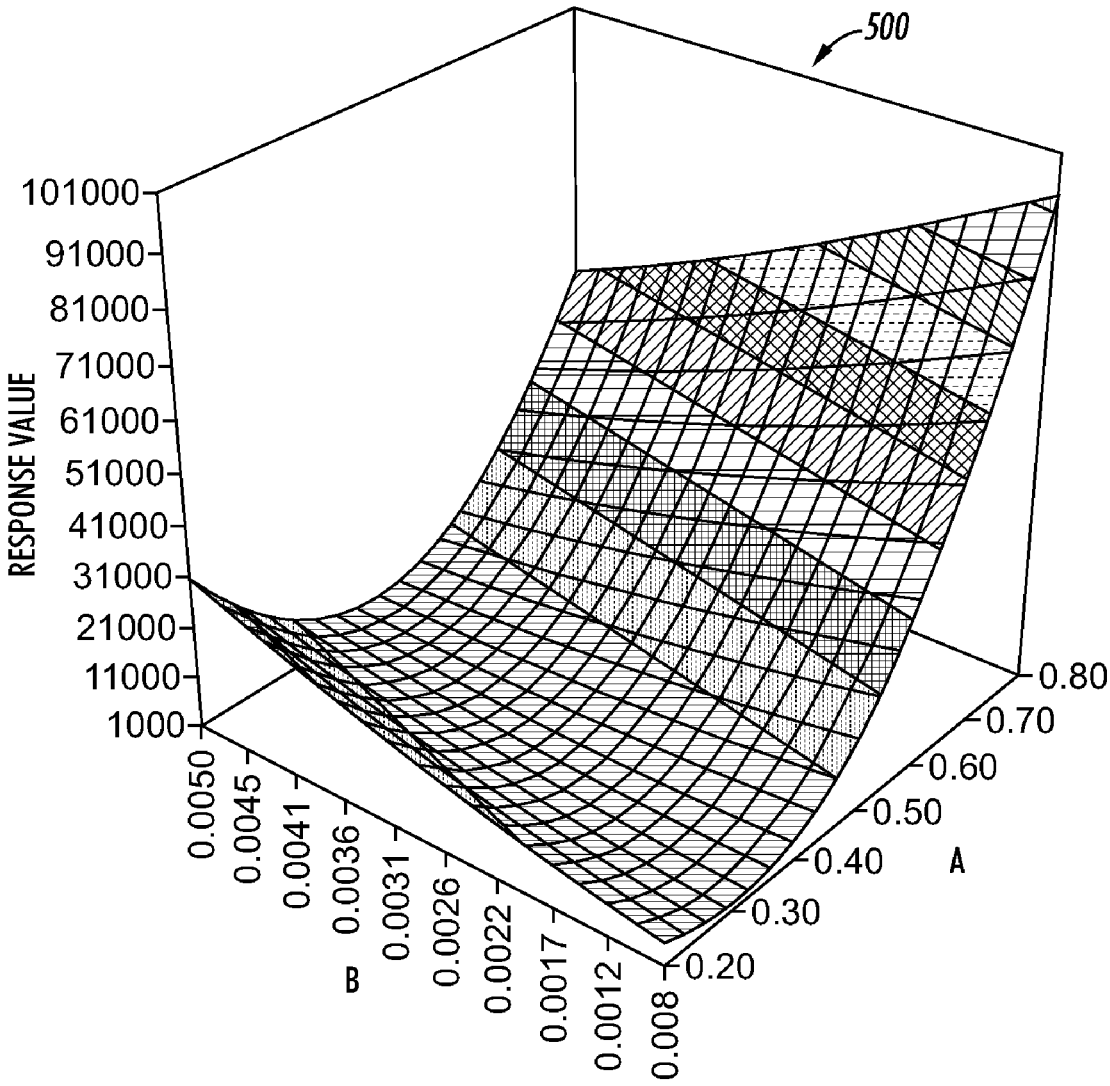
FIG. 5 illustrates an exemplary graph showing a surface plot of a, b, and a response value.

FIG. 5 illustrates an exemplary graph 500 showing a surface plot of a, b, and the resulting response value. The graph 500 shows an example for 60 gsm paper with a target toner-media interface temperature of 125° C., and steady state belt and pressure roll temperatures 170° C. and 80° C. respectively. A design of experiment was used to determine the values of a and b that minimize the error integral. The table below shows the values of the error integral as predicted by simulations for the corresponding values of a and b.

| | a | | | | |
|---|---|---|---|---|---|
| b | 0.2 | 0.3 | 0.4 | 0.6 | 0.8 |
| 0.00075 | 5045.22 | 242.61 | 4692.93 | 37161.50 | 90691.50 |
| 0.001 | 5955.95 | 263.62 | 3948.77 | 35215.70 | 88449.40 |
| 0.0025 | 13531.20 | 2292.42 | 1022.72 | 24336.20 | 74312.00 |
| 0.005 | 34289.30 | 12977.30 | 2624.57 | 10817.90 | 50545.80 |

The graph 500 and the table show the minimum of the integral occurs in the neighborhood of a=0.3 and b=0.00075. These settings were verified in simulations shown in the plot 420 of the toner-media interface temperature as a function of the print number in the graph 400. Thus, a much more uniform toner-media interface temperature can be provided throughout a print job even with a pressure assembly starting from cold.

Figure 6:
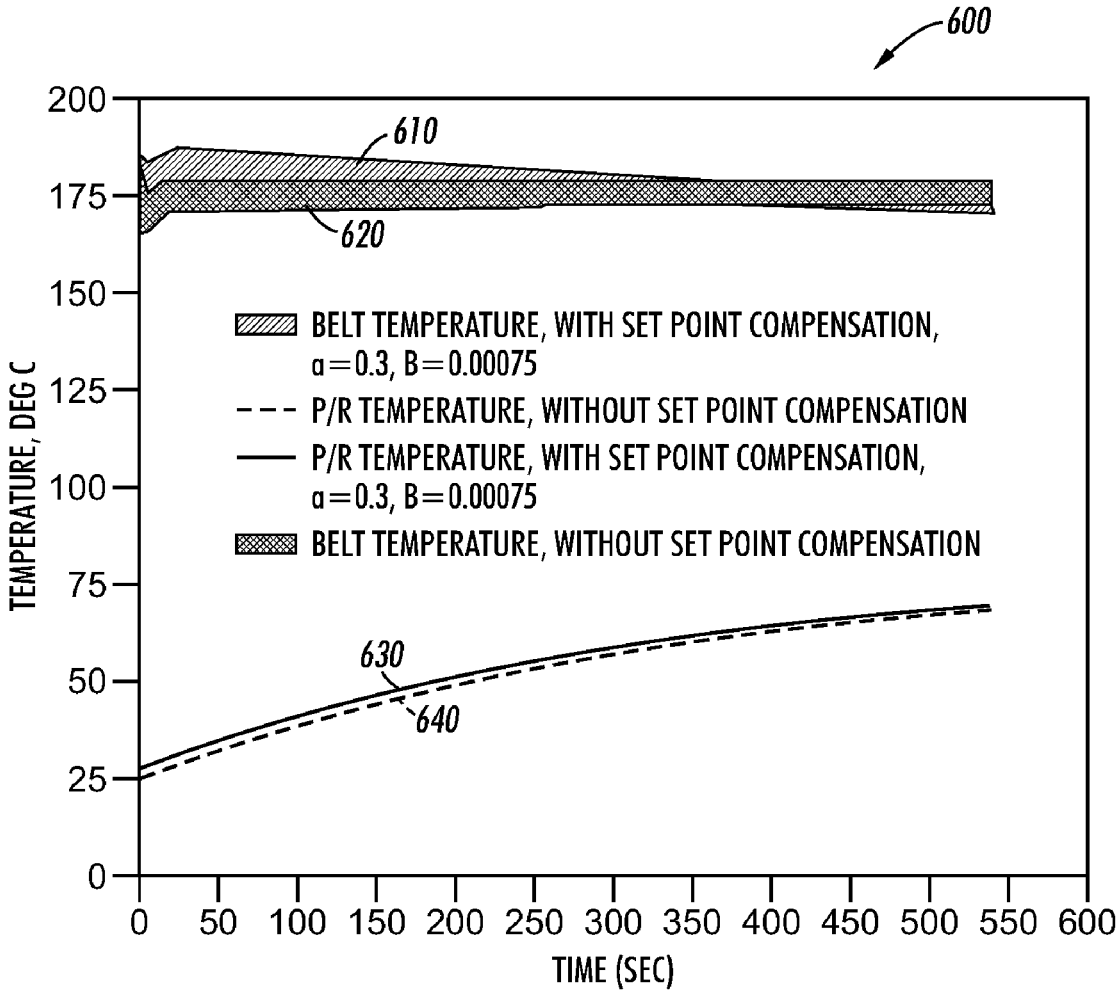
FIG. 6 illustrates an exemplary graph of fuser temperature and pressure assembly temperature as a function of time.

FIG. 6 illustrates an exemplary graph 600 of fuser, such as belt, temperature and pressure assembly, such as pressure roll, temperature as a function of time. The graph 600 shows that, without compensation, the fuser temperature 620 stays fixed even though the pressure assembly 640 starts cold. When using compensation, initially, when the pressure assembly 630 is cold, the fuser temperature 610 is set higher than the nominal steady state temperature so as to maintain a consistent toner-media interface temperature. As the print job progresses and the pressure roll temperature 630 rises, the fuser temperature 610 approaches the nominal set point.

Figure 7:
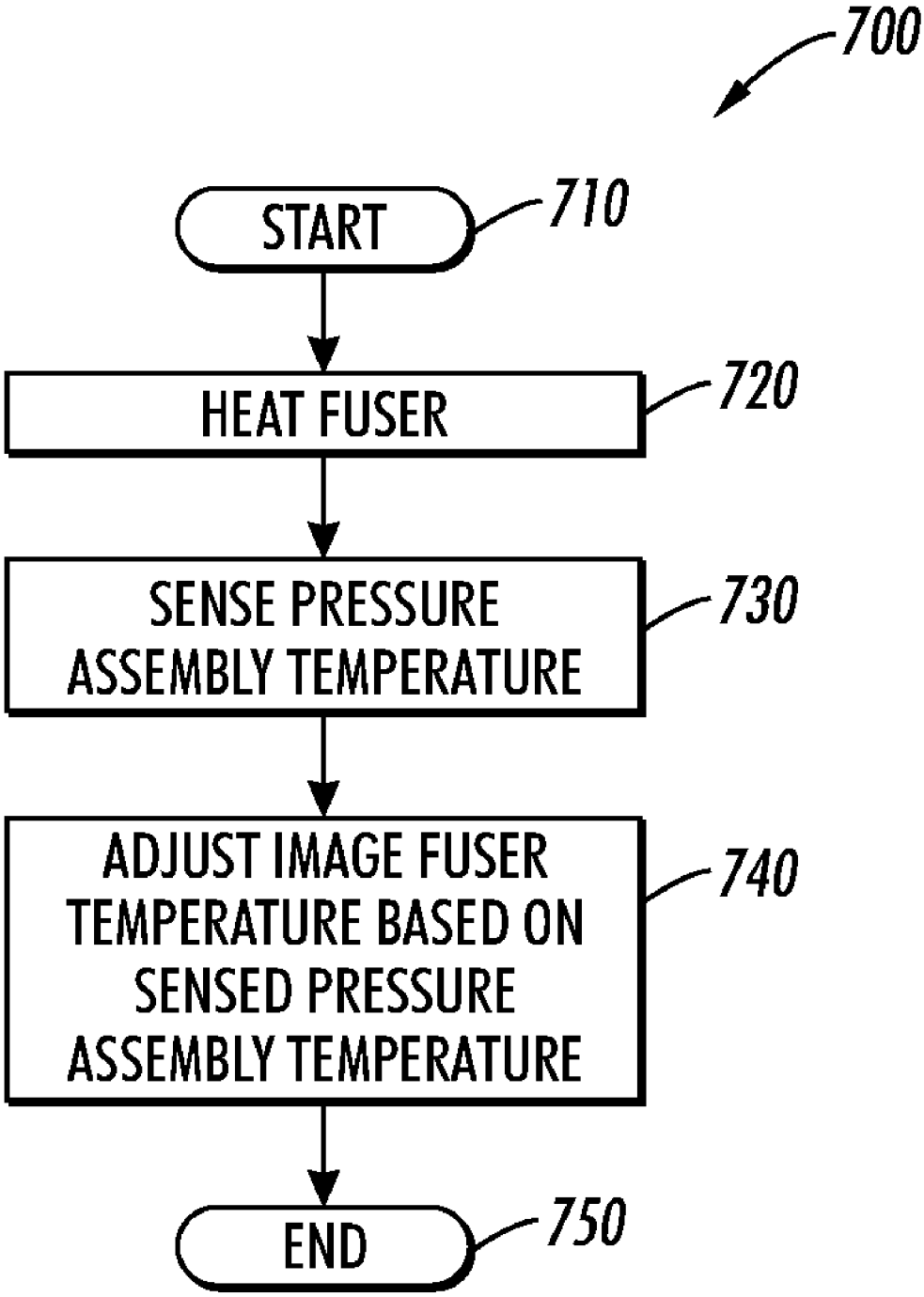
FIG. 7 illustrates an exemplary flowchart of a method of fuser temperature control.

FIG. 7 illustrates an exemplary flowchart 700 of a method of fuser temperature control in an apparatus having an image fuser member rotatably supported in the apparatus, where the image fuser member can be configured to fuse an image on media. The apparatus can also have a pressure assembly rotatably supported in the apparatus and coupled to the image fuser member, where the pressure assembly can be configured to exert pressure against the image fuser member. The method starts at 710. At 720, the image fuser member is heated. At 730, a temperature of the pressure assembly is sensed. At 740, the temperature of the image fuser member is adjusted based on the sensed temperature of the pressure assembly. The temperature can be adjusted by adjusting the temperature of the image fuser member based on the temperature of the pressure assembly to achieve a desired toner-media interface temperature. The temperature can be adjusted by adjusting the temperature of the image fuser member based on the temperature of the pressure assembly to minimize variation of a desired toner-media interface temperature. The temperature can be adjusted by adjusting the temperature of the image fuser member based on the sensed temperature of the pressure assembly, based on a steady state image fuser member temperature for a desired toner-media interface temperature, and based on a steady state pressure assembly temperature for the desired toner-media interface temperature. At 750, the flowchart 700 can end.

Figure 8:
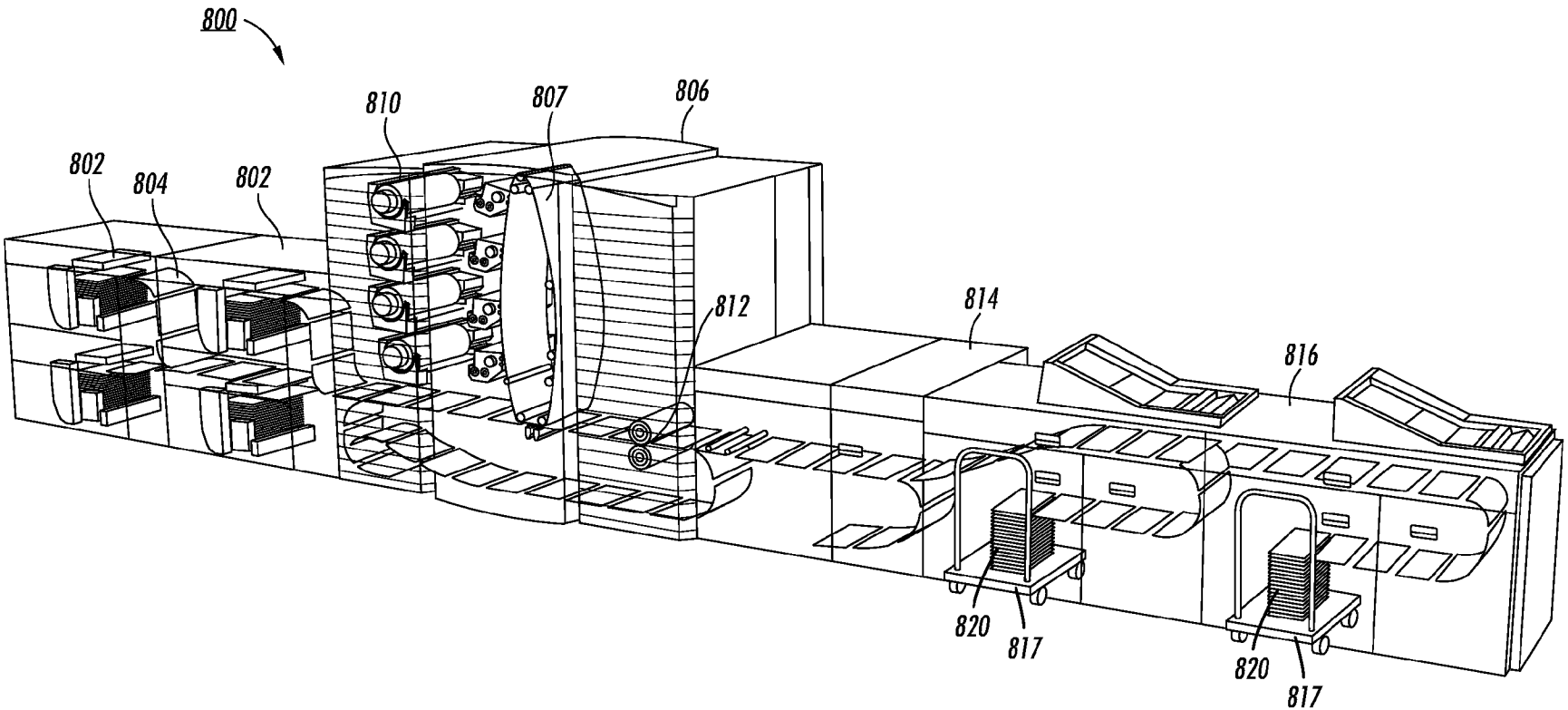
FIG. 8 illustrates an exemplary printing apparatus.

FIG. 8 illustrates an exemplary printing apparatus 800. As used herein, the term "printing apparatus" encompasses any apparatus, such as a digital copier, bookmaking machine, multifunction machine, and other printing devices that perform a print outputting function for any purpose. The printing apparatus 800 can be used to produce prints from various media, such as coated, uncoated, previously marked, or plain paper sheets. The media can have various sizes and weights. In some embodiments, the printing apparatus 800 can have a modular construction. The printing apparatus 800 can include at least one media feeder module 802, a printer module 806 adjacent the media feeder module 802, an inverter module 814 adjacent the printer module 806, and at least one stacker module 816 adjacent the inverter module 814.

In the printing apparatus 800, the media feeder module 802 can be adapted to feed media 804 having various sizes, widths, lengths, and weights to the printer module 806. In the printer module 806, toner is transferred from an arrangement of developer stations 810 to a charged photoreceptor belt 807 to form toner images on the photoreceptor belt 807. The toner images are transferred to the media 804 fed through a paper path. The media 804 are advanced through a fuser 812 adapted to fuse the toner images on the media 804. The fuser 812 can include various elements of the apparatus 100. The inverter module 814 manipulates the media 804 exiting the printer module 806 by either passing the media 804 through to the stacker module 816, or by inverting and returning the media 804 to the printer module 806. In the stacker module 816, printed media are loaded onto stacker carts 817 to form stacks 820.

Figure 9:
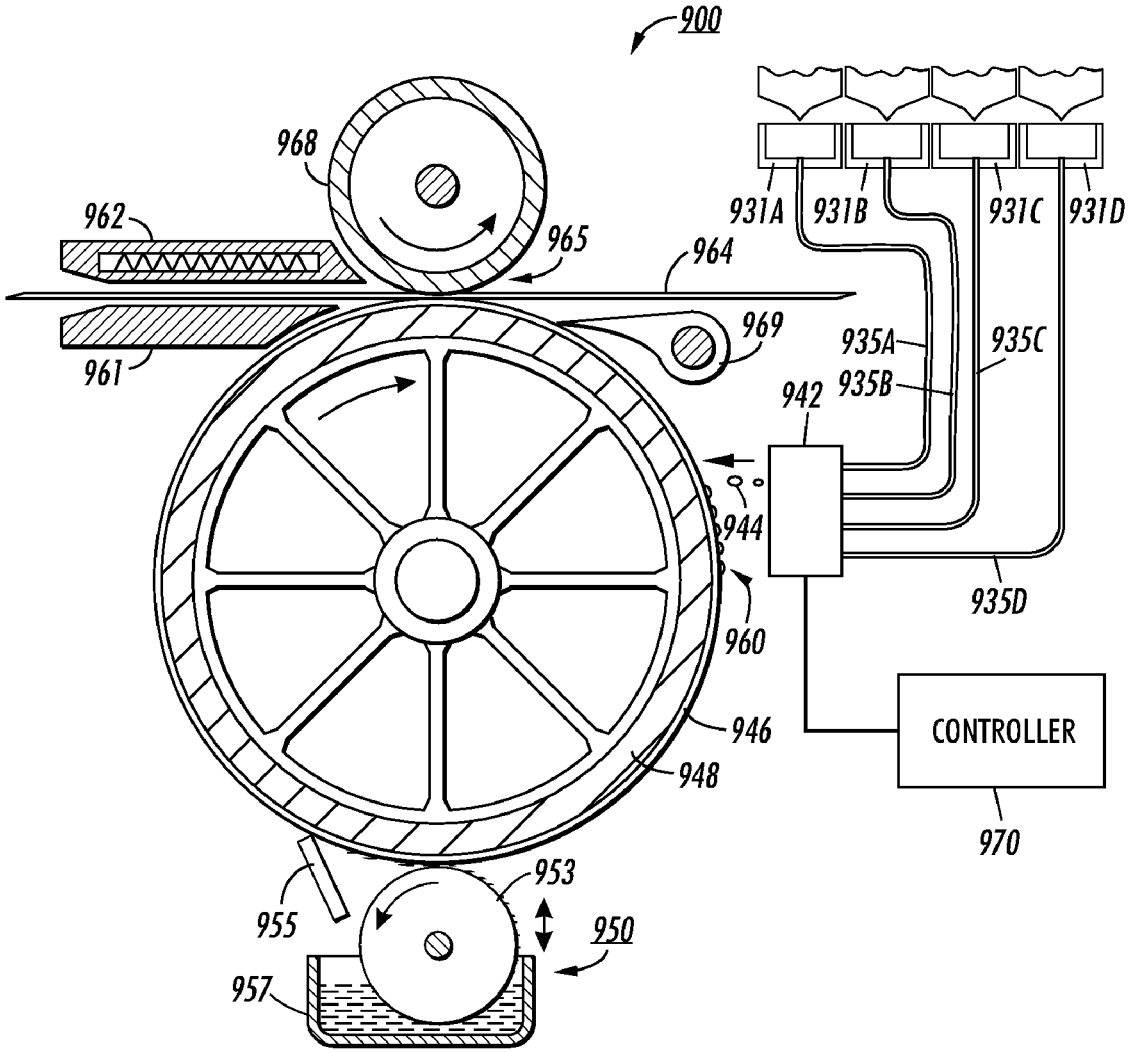
FIG. 9 illustrates an exemplary ink jet printing mechanism.

FIG. 9 illustrates an exemplary ink jet printing mechanism 900 that can include or be part of the apparatus 100. The printing mechanism 900 can include a printhead 942 that is appropriately supported for stationary or moving utilization to emit drops 944 of ink onto an intermediate transfer surface 946 applied to a supporting surface of a print drum 948. The print drum 948 can be the image fuser member 110 of the apparatus 100. The ink is supplied from the ink reservoirs 931A, 931B, 931C, and 931D of the ink supply system through liquid ink conduits 935A, 935B, 935C, and 935D that connect the ink reservoirs 931A, 931B, 931C, and 931D with the printhead 942. The intermediate transfer surface 946 can be a fluid film, such as a functional oil, that can be applied by contact with an applicator such as a roller 953 of an applicator assembly 950. By way of illustrative example, the applicator assembly 950 can include a metering blade 955 and a reservoir 957. The applicator assembly 950 can be configured for selective engagement with the print drum 948. In the illustrative embodiment, the print drum 948 can operate in two rotation cycles where, in a first rotation cycle, the intermediate transfer surface 946 can be applied to the print drum 948 and in a second rotation cycle, the applicator assembly 950 can disengage from the print drum 948 and the printhead 942 can emit drops 944 of ink onto the intermediate transfer surface 946. In another embodiment, the applicator assembly 950 can precede the printhead 942 in an operational direction of the print drum 948 and both the intermediate transfer surface 946 and the ink 944 can be applied to the print drum 948 in one cycle.

The printing mechanism 900 can further include a substrate guide 961, such as the media transport 160, and a media preheater 962 that guides a print media substrate 964, such as paper, through a nip 965, such as the nip 135, formed between opposing actuated surfaces of a roller 968, such as the pressure assembly 130, and the print drum 948. Stripper fingers or a stripper edge 969 can be movably mounted to assist in removing the print medium substrate 964 from the intermediate transfer surface 946 after an image 960 comprising deposited ink drops is transferred to the print medium substrate 964.

A print controller 970 can be operatively connected to the printhead 942. The print controller 970 can transmit activation signals to the printhead 942 to cause selected individual drop generators of the printhead 942 to eject drops of ink 944. The activation signals can energize individual drop generators of the printhead 942.

Embodiments can provide for adjusting a fuser belt or roll temperature set point based on pressure assembly temperature. No cooling or heating of the pressure assembly is required. Also, a consistent toner-media interface temperature can be achieved throughout a print job. Additionally, embodiments can save energy and increase the life of the pressure assembly. Embodiments can apply to any belt fusing system, roll fusing system, roll fusers capable of rapid heating and cooling, or any image production system that uses a heated rotational assembly and a pressure roll.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

an image fuser member rotatably supported in the apparatus, the image fuser member configured to fuse an image on media;

a heater coupled to the image fuser member, the heater configured to heat the image fuser member;

a pressure assembly rotatably supported in the apparatus, the pressure assembly coupled to the image fuser member, the pressure assembly configured to exert pressure against the image fuser member;

a temperature sensor coupled to the pressure assembly, the temperature sensor configured to sense a temperature of the pressure assembly; and a controller coupled to the heater and coupled to the temperature sensor, the controller configured to adjust a temperature set point of the image fuser member based on the sensed temperature of the pressure assembly, wherein the controller is configured to adjust the temperature of the image fuser member based on the temperature of the pressure assembly based on $$T_b = T_{b_ss} + a(T_{pr_ss} - T_{pr}) - b(T_{pr_ss} - T_{pr})^2$$

where $T_b$ represents the adjusted image fuser member temperature set point, where $T_{b_ss}$ represents an image fuser member steady state temperature for a target toner-media interface temperature, where $T_{pr_ss}$ represents a pressure assembly steady state temperature for a target toner-media interface temperature, where $T_{pr}$ represents a measured pressure assembly temperature, and where a and b are coefficients.

2. The apparatus according to claim 1, wherein the temperature of the image fuser member controls the temperature of the pressure assembly.

3. The apparatus according to claim 1, wherein the controller is configured to adjust the temperature set point of the image fuser member based on the temperature of the pressure assembly to achieve a desired toner-media interface temperature.

4. The apparatus according to claim 1, wherein the pressure assembly comprises a pressure roll including a deformable surface.

5. The apparatus according to claim 1, wherein the image fuser member comprises one selected from the group of an image fuser belt and an image fuser roll.

6. The apparatus according to claim 1, wherein the controller is configured to adjust the temperature of the image fuser member based on the temperature of the pressure assembly to provide additional heat to the image fuser member until the pressure assembly reaches a desired steady state temperature.

7. The apparatus according to claim 1, wherein the controller is configured to adjust the temperature set point of the image fuser member based on the temperature of the pressure assembly according to a temperature of the pressure assembly measured by the temperature sensor and based on a desired toner-media interface temperature.

8. The apparatus according to claim 7, wherein the desired toner-media interface temperature is based on a media weight of media having the image fused by the fuser assembly.

9. The apparatus according to claim 1, wherein the controller is configured to adjust the temperature set point of the image fuser member based on a temperature of the pressure assembly measured by the temperature sensor, based on a desired steady state image fuser member temperature for a desired toner-media interface temperature, and based on a desired steady state pressure assembly temperature for the desired toner-media interface temperature.

10. The apparatus according to claim 1, wherein a and b are determined to substantially minimize a difference between a toner-media interface temperature resulting from the adjusted image fuser member temperature and a desired toner-media interface temperature.

11. The apparatus according to claim 1, wherein a and b are determined to substantially minimize an error integral based on $$\int (T_{t\text{-}p} - T_{t\text{-}p,\,target})^2$$

where $T_{t\text{-}p}$ represents a toner-media interface temperature resulting from the adjusted image fuser member temperature, and where $T_{t\text{-}p,\,target}$ represents a desired toner-media interface temperature.

12. The apparatus according to claim 11, where $T_{t\text{-}p}$ represents a toner-media interface temperature resulting from the adjusted image fuser member temperature from a look-up table.

13. The apparatus according to claim 11, where $T_{t\text{-}p}$ represents a toner-media interface temperature resulting from the adjusted image fuser member temperature according to a model.

14. An apparatus comprising:

a media transport configured to transport media;

a marking module configured to mark a toner image on the media;

an image fuser member rotatably supported in the apparatus, the image fuser member configured to fuse the toner image on the media;

a heater coupled to the image fuser member, the heater configured to heat the image fuser member;

a pressure assembly rotatably supported in the apparatus, the pressure assembly coupled to the image fuser member at a nip, the pressure assembly configured to exert pressure against the media in the nip;

a temperature sensor coupled to the pressure assembly, the temperature sensor configured to sense a temperature of the pressure assembly; and a controller coupled to the heater and coupled to the temperature sensor, the controller configured to adjust a temperature set point of the image fuser member based on the temperature of the pressure assembly to achieve a desired toner-media interface temperature, wherein the controller is configured to adjust the temperature of the image fuser member based on the temperature of the pressure assembly based on $$T_b = T_{b_ss} + a(T_{pr_ss} - T_{pr}) - b(T_{pr_ss} - T_{pr})^2$$

where $T_b$ represents the adjusted image fuser member temperature set point, where $T_{b_ss}$ represents an image fuser member steady state temperature for a target toner-media interface temperature, where $T_{pr_ss}$ represents a pressure assembly steady state temperature for a target toner-media interface temperature, where $T_{pr}$ represents a measured pressure assembly temperature, and where a and b are coefficients.

15. The apparatus according to claim 14, wherein the controller is configured to adjust the temperature set point of the image fuser member based on a temperature of the pressure assembly measured by the temperature sensor, based on a steady state image fuser member temperature for the desired toner-media interface temperature, and based on a steady state pressure assembly temperature for the desired toner-media interface temperature.

16. A method in an apparatus including an image fuser member rotatably supported in the apparatus, the image fuser member configured to fuse an image on media and including a pressure assembly rotatably supported in the apparatus, the pressure assembly coupled to the image fuser member, the pressure assembly configured to exert pressure against the image fuser member, the method comprising:

heating the image fuser member;

sensing a temperature of the pressure assembly; and adjusting a temperature set point of the image fuser member based on the sensed temperature of the pressure assembly, wherein adjusting comprises adjusting the temperature of the image fuser member based on the temperature of the pressure assembly based on $$T_b = T_{b_ss} + a(T_{pr_ss} - T_{pr}) - b(T_{pr_ss} - T_{pr})_2$$

where $T_b$ represents the adjusted image fuser member temperature set point, where $T_{b_ss}$ represents an image fuser member steady state temperature for a target toner-media interface temperature, where $T_{pr_ss}$ represents a pressure assembly steady state temperature for a target toner-media interface temperature, where $T_{pr}$ represents a measured pressure assembly temperature, and where a and b are coefficients.

17. The method according to claim 16, wherein adjusting comprises adjusting the temperature set point of the image fuser member based on the temperature of the pressure assembly to achieve a desired toner-media interface temperature.

18. The method according to claim 16, wherein adjusting comprises adjusting the temperature set point of the image fuser member based on the temperature of the pressure assembly to minimize variation of a desired toner-media interface temperature.

19. The method according to claim 16, wherein adjusting comprises adjusting the temperature set point of the image fuser member based on the sensed temperature of the pressure assembly, based on a steady state image fuser member temperature for a desired toner-media interface temperature, and based on a steady state pressure assembly temperature for the desired toner-media interface temperature.

* * * * *